US005179748A

United States Patent [19]

Lipic

[11] Patent Number: 5,179,748

[45] Date of Patent: Jan. 19, 1993

[54] KEY RING AND SCREWDRIVER DEVICE

[75] Inventor: Joseph G. Lipic, St. Louis, Mo.

[73] Assignee: Alexander Manufacturing Company, St. Louis, Mo.

[21] Appl. No.: 804,914

[22] Filed: Dec. 11, 1991

[51] Int. Cl.[5] ..... B25F 1/02

[52] U.S. Cl. ..... 7/165; 7/167; 81/439; 81/490; 70/456 R

[58] Field of Search ..... 7/165, 167, 170; 81/439, 490; 70/456 R

[56] References Cited

U.S. PATENT DOCUMENTS

| | | | |
|---|---|---|---|
| 504,757 | 9/1893 | Schuermann | 81/439 |
| 2,022,775 | 12/1935 | Holland-Letz | 81/439 |
| 4,248,071 | 2/1981 | Kussoy | 70/456 R |
| 4,300,607 | 11/1981 | Mellinger | 81/490 |
| 4,631,770 | 12/1986 | Goldberg | 70/456 R |
| 4,827,812 | 5/1989 | Markovetz | 81/490 |

FOREIGN PATENT DOCUMENTS

| | | | |
|---|---|---|---|
| 1055179 | 10/1953 | France | 70/456 R |

*Primary Examiner*—Roscoe V. Parker

*Attorney, Agent, or Firm*—Polster, Lieder, Woodruff & Lucchesi

[57] ABSTRACT

A key ring and screwdriver device is disclosed as including a hollow tubular handle having opposite open ends. A reversible screwdriver having different blade ends at an intermediate polygonal cross sectional area is capable of being stored in one open end of the hollow tubular handle. At the opposite open end of the hollow tubular handle, a ferrule is provided. The ferrule includes an outer internally threaded section and inner polygonally shaped section. The outer internally threaded section has a cross sectional dimension greater than the reversible screwdriver blade in order to freely accommodate same. The inner polygonally shaped section has a complementary shape and size for receiving the intermediate polygonal cross sectional area of the reversible screwdriver blade in driving engagement therewith. At least one key ring is provided which has a threaded end for complementary threaded engagement with the outer threaded section of the ferrule element when the screwdriver blade is stored in the opposite open end of the hollow tubular handle. A second key ring may also be provided with a threaded end for complementary threaded engagement with an internally threaded area on the opposite open end of the hollow tubular handle, in order to capture the screwdriver blade in the hollow tubular handle.

3 Claims, 1 Drawing Sheet

KEY RING AND SCREWDRIVER DEVICE

BACKGROUND OF THE INVENTION

The present invention relates to a key ring and screwdriver device, and more particularly to a device having key rings threadably and releasably mounted to opposite ends of a hollow tubular handle, with a reversible screwdriver stored in one open end of the hollow tubular device and capable of being insertable into an opposite open end of the hollow tubular device for driving engagement therewith.

Consumers are well aware of a variety of different types and kinds of key ring devices that are used to hold keys. As distinguished from the several different kinds of key ring devices that are available, the present invention is directed to a combined key ring and screw driver device.

Combined key ring and screwdriver devices are known in the art as including a hollow tubular handle with a key ring threadably and releasably mounted to one open end of the hollow tubular handle. Stored within this open end is a reversible screwdriver blade having different blade ends, i.e., a regular screwdriver blade on one end and a phillips head blade on the other. At the opposite open end of the hollow tubular handle, a ferrule is provided with a polygonal shape that corresponds to the polygonal shape of the reversible screwdriver blade intermediate the different blade ends. This enables the consumer/user to unscrew the key ring from the hollow tubular handle, remove the reversible screwdriver blade stored therein, and insert the reversible screwdriver blade in the ferrule at the opposite open end of the hollow tubular handle, in order to enable the hollow tubular handle and screwdriver blade to function as a screwdriver.

While such aforementioned devices have worked quite well, they do not permit the use of a second key ring on the ferrule end of the hollow tubular element because the ferrule has no way of securing a second key ring and at the same time permit the reversible screwdriver blade to be mounted in driving engagement therewith. Accordingly, the present invention is intended to improve upon and enhance the versatility of such known key ring and screwdriver devices by enabling the key ring to be threadably associated with the same open end of the hollow tubular handle that receives the reversible screwdriver blade in driving engagement therewith.

SUMMARY OF THE INVENTION

Among the several objects and advantages of the present invention include:

The provision of a new and improved key ring and screwdriver device which enhances the versatility and use of such devices;

The provision of the aforementioned new and improved key ring and screwdriver device wherein a hollow tubular handle is adapted to receive a key ring on the same open end that drivingly engages a reversible screwdriver blade, normally stored in the opposite open end of the tubular handle when not in use;

The provision of the aforementioned new and improved key ring and screwdriver device wherein first and second key rings are threadably and releasably associated with opposite open ends of the tubular handle;

The provision of the aforementioned new and improved key ring and screwdriver device which includes a ferrule element that permits threadable and releasable engagement with a second key ring, while also permitting driving engagement with the reversible screwdriver blade; and The provision of the aforementioned new and improved key ring and screwdriver device which is simple and easy to construct, economical to manufacture, affords additional and varied options to the consumer/user and is otherwise well adapted for the purposes intended.

Briefly stated, the present invention relates to a key ring and screwdriver device including a hollow tubular handle having opposite open ends. A reversible screwdriver blade is provided with different blade ends and an intermediate polygonal cross sectional area. The reversible screwdriver blade is adapted to be inserted into one end of the hollow tubular handle for storage therein. A ferrule is mounted on an opposite open end of the hollow tubular handle. The ferrule includes an outer internally threaded section adjacent the associated open end of the hollow tubular handle and an inner polygonally shaped section spaced from the associated open end of the hollow tubular handle. The outer internally threaded section has a cross sectional dimension greater than the reversible screwdriver blade in order to freely accommodate same. The inner polygonally shaped section has a complementary shape and size for receiving the intermediate polygonal cross sectional area of the reversible screwdriver blade in driving engagement therewith. A key ring having a threaded end for complementary threaded engagement with the outer threaded section of the ferrule is provided when the screwdriver blade is insertable in the opposite open end of the hollow tubular handle for storage therein. The device may further include a second key ring having a threaded end for complementary threaded engagement with an internally threaded area adjacent the outer open end of the hollow tubular handle in which the screwdriver blade is inserted. The second key ring captures the screwdriver blade in the hollow tubular handle when threadably engagement with the internal threaded area of the hollow tubular handle.

Preferably, 0-rings are positioned in the hollow tubular handle between the ferrule and an inner shoulder in the hollow tubular handle. The inner diameter of the 0-rings is smaller than the intermediate cross sectional area of the reversible screwdriver blade for releasably retaining same relative to the hollow tubular handle.

These and other objects and advantages of the present invention will be apparent from the description that follows.

BRIEF DESCRIPTION OF THE DRAWINGS

In the drawings, FIG. 1 a front elevational view of the new and improved key ring and screwdriver device which is constructed in accordance with the teachings of the present invention.

Figure 1:
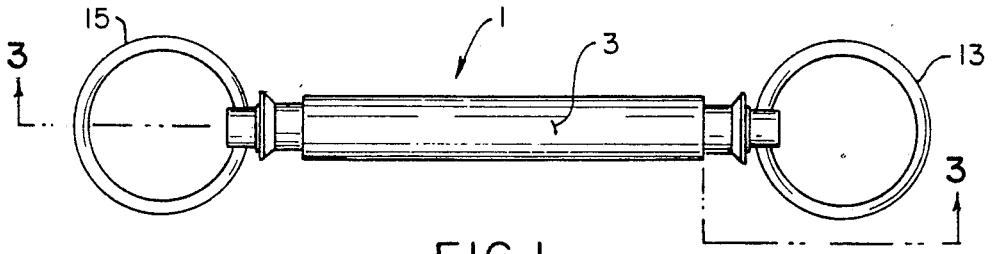
Figure 2:
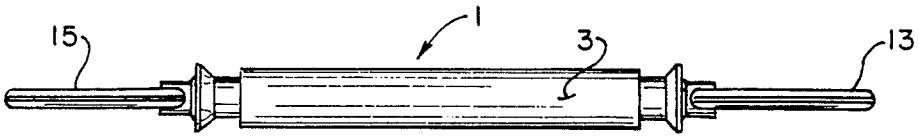
FIG. 2 is an elevational view similar to FIG. 1, but showing the key rings at opposite ends thereof in a position transverse to that in FIG. 1.

Corresponding references numerals will be used throughout the several figures of the drawings.

DESCRIPTION OF THE PREFERRED EMBODIMENT

The following detailed description illustrates the invention by way of example and not by way of limitation. This description will clearly enable one skilled in the art to make and use the invention, and describe several embodiments, adaptions, variations, alternatives and uses of the invention, including what I presently believe is the best mode of carrying out the invention.

As shown in FIGS. 1-10 of the drawings, the new and improved key ring and screwdriver device is generally identified by the numeral 1. Each such key ring and screwdriver device 1 includes a hollow tubular or cylindrical handle 3 which is preferably injection molded from a suitable plastic material.

The opposite open ends 5, 7, and the hollow interiors 9, 25 of the hollow tubular element 3, are constructed to receive the reversible screwdriver blade 11 and associated key rings 13, 15, as will be described in detail below.

Figure 3:
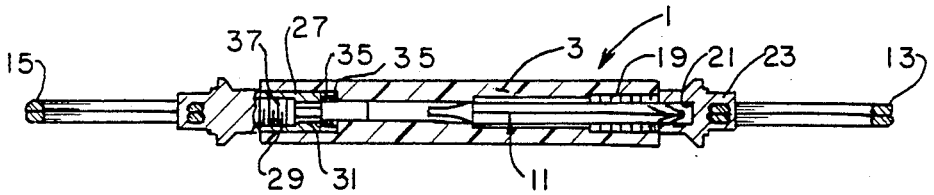
FIG. 3 is a sectional view of the improved key ring and screwdriver as viewed along line 3—3 of FIG. 1.
Figure 4:
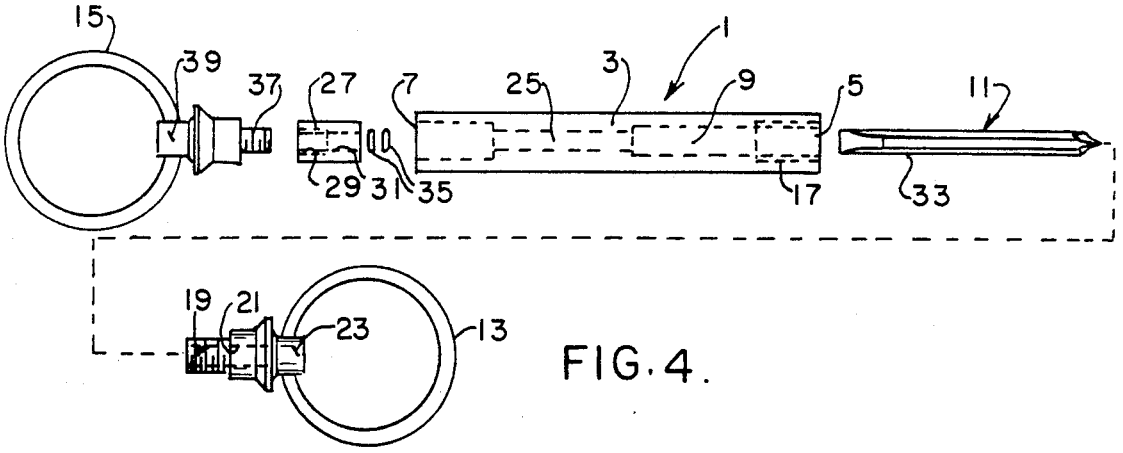
FIG. 4 is an exploded elevational view of the various components forming the key ring and screwdriver device.
Figures 5, 6, 7, 8, 9:
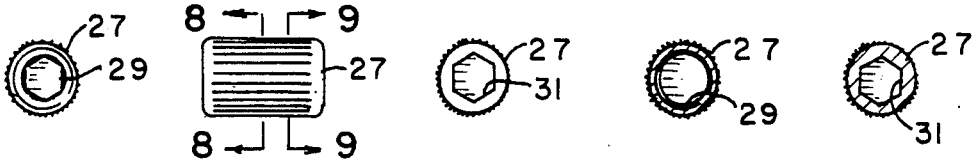
FIG. 5 is a elevational view of the ferrule element mounted in one the hollow tubular handle.
FIG. 6 is an end elevational view of one end of the ferrule element shown in FIG. 5.
FIG. 7 is an end elevational view of the opposite end of the ferrule element from that shown in FIG. 6.
FIG. 8 is a sectional view of the ferrule element as viewed along line 8—8 of FIG. 5.
FIG. 9 is a sectional view of the ferrule element as viewed along line 9—9 of FIG. 9.

With respect to the open end 5 and the hollow interior 9 on the right side of the hollow tubular handle 3, it will be noted that the interior shape and configuration are such as to freely receive the reversible screwdriver blade 11 therein, by simply inserting the reversible screwdriver 11 from the position shown in FIG. 4 to the storage condition within the hollow tubular handle 3, as shown in FIG. 3 of the drawings. Preferably, the area adjacent the outer open end 5 of the hollow interior 9 is internally threaded as at 17 for complementary releasable and threaded engagement with an externally threaded stub 19 of the key ring 13. Thus, when the key ring 13 is threadably associated, via the internally threaded and externally threaded complementary components 17, 19, the reversible screwdriver blade 11 is captured Within the hollow interior 9, as best illustrated in FIG. 3. In that figure, it will also be seen that the interior of the threaded stub 19 is also preferably provided with a hollow configuration as at 21 to receive one end of the reversible screwdriver blade 11. The key ring 13 is itself freely rotatably received Within an oppositely extending stub shaft 23, which extends in an opposite direction to the threaded stub shaft 19, as illustrated.

The opposite open end 7 of the hollow tubular handle 3 and a second hollow interior space 25 adjacent thereto are constructed for receiving a ferrule element 27 that incorporates features for both receiving the reversible screwdriver blade 11 in driving engagement or the second key ring 15 in threadable association.

Figure 10:
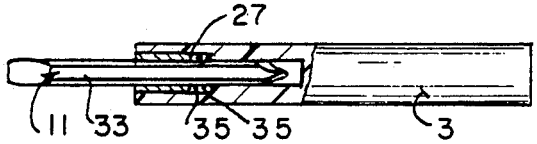
FIG. 10 is an elevational view of the hollow tubular handle with a reversible screwdriver blade drivingly engaged within the ferrule element at one open end of the hollow tubular handle.

In this connection, the ferrule element 27 is constructed as shown in FIGS. 5-9 of the drawings as having outer ribs (not labeled) circumferentially spaced about the cylindrically shaped ferrule element 27 for structural interengagement with inner wall areas adjacent the opposite open end 7 of the hollow tubular element 3, as illustrated. The ferrule element 27 also includes an outer internally threaded section 29 an an inner polygonally shaped section 31. The outer internally threaded section 29 has a cross sectional dimension greater than the reversible screwdriver blade 11 in order to freely accommodate same therethrough. On the other hand, the inner polygonally shaped section 31 has a complementary shape and size for receiving the intermediate polygonal cross sectional area 33 of the reversible screwdriver blade 11 in driving engagement therewith. This permits the hollow tubular handle 3 and the reversible screwdriver blade II, when inserted within the inner polygonally shaped section 31, to function as a screwdriver, as illustrated in FIG. 10 of the drawings.

As illustrated best in FIGS. 3-4 of the drawings, a pair of O-rings 35 are first mounted on a shoulder spaced from the open outer end 7 of the hollow tubular element 3, and then the ferrule element 27 is inserted in the open outer end 7 for structural interengagement with surrounding walls, as illustrated. The pair of 0-rings 35 have a smaller internal diameter than the intermediate cross sectional area 33 of the reversible screwdriver blade 11, in order to releasable retain the reversible screwdriver blade 11 relative to the hollow tubular handle 3, for use as a screwdriver.

The outer internally threaded section 29 of the ferrule element 27 is threadably dimensioned for complementary threaded engagement with a threaded stub shaft 37 at the outer free end of the second key ring 15 when the reversible screw driver blade 11 is stored within the hollow tubular handle, as illustrated in FIG. 3 of the drawings. At the opposite end of the threaded stub shaft 37 is a second stub shaft 39 for freely rotatably receiving the key ring 15, in the same manner as previously described in connection with key ring 13.

From the foregoing, it will now be appreciated that the reversible screwdriver blade 11, which can have a regular or "phillips" head blade at opposite ends thereof, can be stored within the hollow tubular handle 3, when the key ring and screwdriver device functions solely as a key ring holder. In such instance, one key ring 13 has an externally threaded stub shaft 19 threadably associated with an internally threaded area 17 adjacent the open end 5 of the hollow tubular member 3. At the opposite end of the hollow tubular handle 3, another key ring 15, through its stub shaft 37, is threadably associated with the outer internally threaded section 29 of the ferrule element 27, as best shown in FIG. 3 of the drawings.

When it is desired to use the device as a screwdriver, key ring 13 is threadably disassociated relative to the hollow tubular handle 3, allowing the reversible screwdriver blade 11 to be removed therefrom. Key ring 15 is also threadably disassociated relative to the ferrule element 27. This enables the consumer/user to insert the reversible screwdriver blade 11 into the ferrule element 27, allowing the intermediate polygonal cross sectional area 33 of the reversible screwdriver blade 11 to drivingly engage the inner polygonally shaped section 31 of the ferrule element. This is shown in FIG. 10 of the drawings where the reversible screwdriver blade 11, when mounted within the ferrule element 27 as described above, couples the hollow tubular element 3 to the reversible screwdriver blade 11, in order that it can function as a screwdriver.

As will now be appreciated, the key ring and screwdriver device of the present invention provides a unique device that functions as a one or two ring keyholder, together in conjunction with a reversible screwdriver blade, enabling the device to be readily converted to a screwdriver, as described above.

In view of the above, it will be seen that the several objects and features of this invention are achieved and other advantages results obtained.

As various changes could be made in the above constructions without departing from the scope of this invention, it is intended that all matter contained in the above description or shown in the accompanying drawings shall be interpreted as illustrative and not in a limiting sense.

What is claimed is:

1. A key ring and screw driver device comprising:

a hollow tubular handle having opposite open ends;

a reversible screw driver blade having different blade ends and an intermediate polygonal cross sectional area, said reversible screw driver blade insertable into one open end of said hollow tubular handle for storage therein;

a ferrule mounted in the opposite open end of said hollow tubular handle, said ferrule having an outer internally threaded section adjacent the associated open end of said hollow tubular handle and an inner polygonally shaped section spaced from the associated open end of said hollow tubular handle, the outer internally threaded section having a cross sectional dimension greater than said reversible screw driver blade in order to freely accommodate same, the inner polygonally shaped section having a complementary shape and size for receiving the intermediate polygonal cross sectional area of said reversible screw driver blade in driving engagement therewith; and a key ring having a threaded end for complementary threaded engagement with the outer threaded section of said ferrule when the screw driver blade is insertable in said one open end of said hollow tubular handle for storage therein.

2. The device as defined in claim 1 and further including a second key ring having a threaded end for complementary threaded engagement with an internally threaded area adjacent the outer open end of said hollow tubular handle in which the screw driver blade is inserted, said second key ring capturing said screw driver blade in said hollow tubular handle when treadably engagement with said internally threaded area of said hollow tubular handle.

3. The device as defined in claim 2 and including O-rings positioned in said hollow tubular handle between said ferrule and an inner shoulder in said hollow tubular handle, the inner diameter of said O-rings being smaller than the intermediate cross sectional area of said reversible screw drive blade for releasably retaining same.

* * * * *

UNITED STATES PATENT AND TRADEMARK OFFICE

CERTIFICATE OF CORRECTION

PATENT NO. : 5,179,748

DATED : January 19, 1993

INVENTOR(S) : Joseph G. Lipic

It is certified that error appears in the above-identified patent and that said Letters Patent is hereby corrected as shown below:

Column 2, Line 65 is "and screwdriver as viewed", should be -- and screwdriver device as viewed --; and Column 3, Line 2 is "mounted in on the hollow", should be -- mounted in one end of the hollow --.

Signed and Sealed this

Seventh Day of December, 1993

*Attest:*

Bruce Lehman

BRUCE LEHMAN

*Attesting Officer*

*Commissioner of Patents and Trademarks*